US006085564A

United States Patent [19]

Veit et al.

[11] Patent Number: 6,085,564

[45] Date of Patent: Jul. 11, 2000

[54] DEVICE FOR SETTING THE ADJUSTABLE ROLLERS OF A STRAIGHTENING UNIT

[75] Inventors: Gustav Veit, Sondelfingen; Eckehard Albert, Berlin, both of Germany

[73] Assignee: Witels Apparate-Maschinen Albert GmbH & Co. KG, Berlin, Germany

[21] Appl. No.: 09/248,360

[22] Filed: Feb. 10, 1999

[30] Foreign Application Priority Data

Jun. 26, 1998 [DE] Germany ..... 198 28 675

[51] Int. Cl.[7] ..... B21D 3/02

[52] U.S. Cl. ..... 72/164

[58] Field of Search ..... 72/164, 165, 244, 72/248

[56] References Cited

U.S. PATENT DOCUMENTS

| | | | |
|---|---|---|---|
| 2,517,343 | 8/1950 | Picton | 72/164 |
| 4,380,921 | 4/1983 | Matsui | 72/165 |

FOREIGN PATENT DOCUMENTS

| | | | |
|---|---|---|---|
| 74522 | 12/1970 | Germany | 72/165 |
| 24 56 782 | 6/1975 | Germany . | |
| 33 09 572 A1 | 9/1984 | Germany . | |
| 3421410 | 1/1985 | Germany | 72/164 |
| 46-42606 | 12/1971 | Japan | 72/164 |
| 56-114527 | 9/1981 | Japan | 72/164 |
| 1-113122 | 5/1989 | Japan | 72/164 |
| 3-294018 | 12/1991 | Japan | 72/164 |

OTHER PUBLICATIONS

D. Ruppin and Y. Rastegar, "Untersuchungen zu den axialen Zugbelastungen von Stahldrähten beim Richten im Vielrollen–Richtapparat und zur Rollenzustellung", *Institut für Werkstofftechnik der TU Berlin*, Witels Albert.

*Primary Examiner*—Daniel C. Crane
*Attorney, Agent, or Firm*—Pauley Petersen Kinne & Fejer

[57] ABSTRACT

A method for setting a straightening roller of a straightening unit designed to be translationally adjustable with an adjusting mechanism, and a setting device for performing the method. Each straightening roller to be adjusted is individually identified and then coupled, if necessary with simultaneous setting of an aligned mutual position, to the adjusting mechanism, whereby the respective position of the straightening roller is determined after the coupling and the position of the straightening roller, which is pre-selected and/or pre-calculated dependent on the process material, dimensions and straightening process, and is then set in relation to a previously determined limit position. The setting device has a roller positioner, a detachable coupling arranged between the roller positioner and the adjusting mechanism of an adjustable straightening roller of the straightening unit, whereby one coupling part is connected to the adjusting mechanism and another coupling part to the roller positioner, a sensor device is used to determine the actual position of the currently coupled straightening roller in relation to a limit position, and an initiablizable actuator is used for the automatic setting of a specific pre-selectable and/or calculable position of the coupled straightening roller in relation to the limit position.

10 Claims, 3 Drawing Sheets

DEVICE FOR SETTING THE ADJUSTABLE ROLLERS OF A STRAIGHTENING UNIT

BACKGROUND OF THE INVENTION

1. Field of the Invention

This invention relates to a method and a device for setting a roller of a straightening unit designed to be translationally adjustable with an adjusting mechanism.

2. Description of Prior Art

The rollers of known straightening units with adjustable rollers are connected to adjusting mechanisms, for example, which have setting screws, adjusting gears to generate linear forces piston rods or gear racks, for example, and permit the individual setting of each roller, whereby the setting is mainly dependent on the operator's experience. Straightening units having an actuator and an adjusting mechanism assigned to each adjustable roller are also known, whereby the automatic adjustment of the rollers is possible depending on previously entered and/or calculated and/or already stored parameters.

Manual adjustment is unable to achieve the required quality of straightening in a process material reproducibly. Automatic setting, on the other hand, particularly using pre-selected data, is able to achieve the required quality, but units of this type are cost-intensive on account of their numerous individual drives as well as the necessary electronics.

SUMMARY OF THE INVENTION

One object of this invention is to specify a setting device for setting the rollers of any straightening unit designed to be translationally adjustable with an adjusting mechanism, which is suitable to make any settings on any adjustable rollers, including those from diverse straightening unit with different adjusting mechanisms.

This object is accomplished by a method with the features of claim 1 and by a setting device with the features of claim 2.

Further embodiments of this invention are discussed in this specification and are set forth in the dependent claims.

BRIEF DESCRIPTION OF THE DRAWINGS

This invention will be described in more detail in the following with reference to the figures wherein.

DESCRIPTION OF PREFERRED EMBODIMENTS

Figure 1:
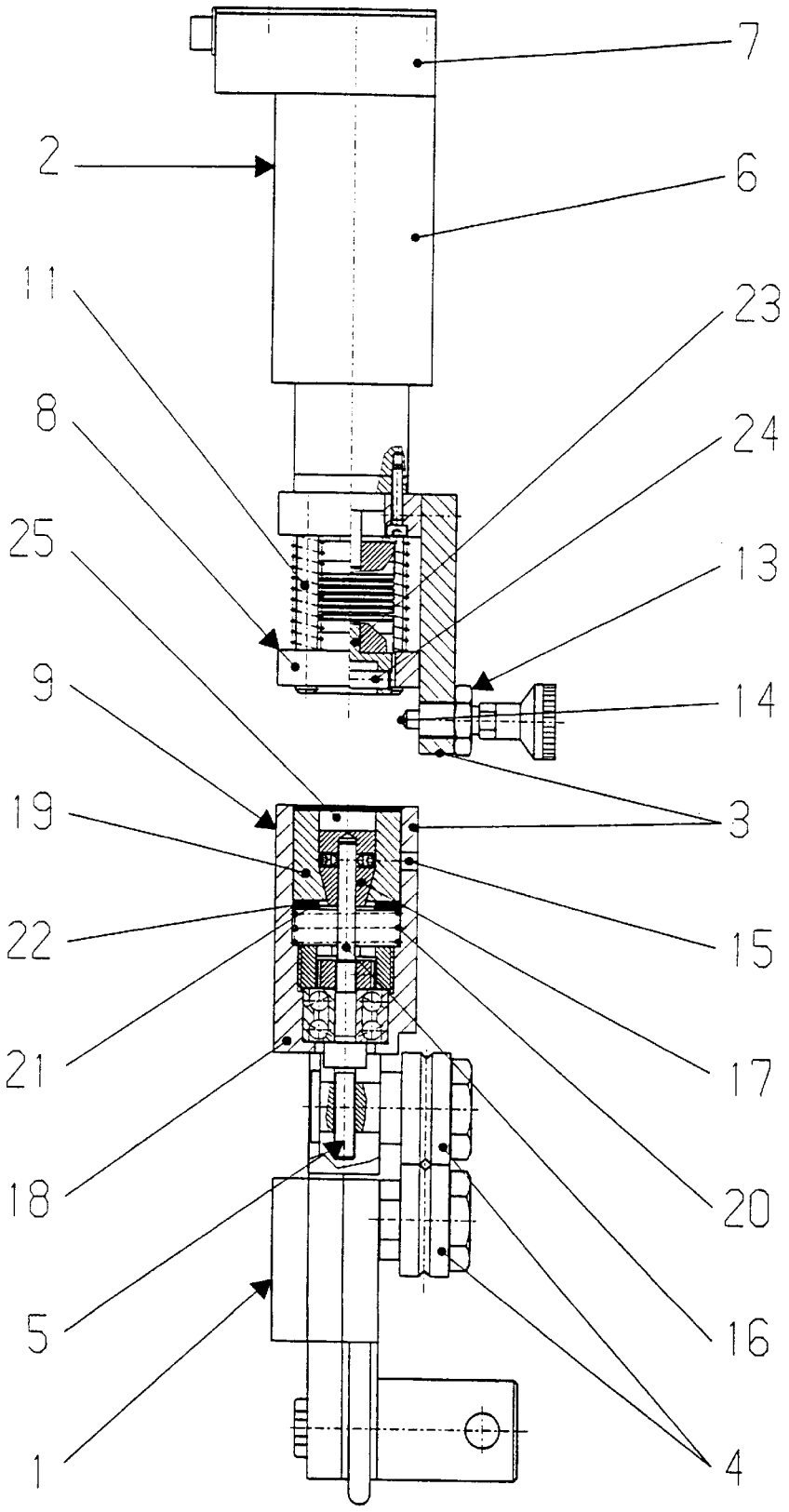
FIG. 1 is a partial sectional side view of a setting device in axial alignment to a separately arranged straightening unit, in an uncoupled state.

The setting device has a straightening unit 1 and a roller positioner 2, which are comprised of two separate parts designed to be connected together by means of a coupling 3. The straightening unit 1 has straightening rollers 4, of which at least one is translationally adjustable by means of an adjusting mechanism 5. The roller positioner 2 has an actuator 6 and a position sensor 7 as well as a coupling part 8 that can be coupled to a coupling part 9 arranged in this embodiment on the straightening unit 1.

To facilitate the coupling, the roller positioner 2 in the embodiment has guide pins 11 which can be inserted in corresponding holes 12 in the straightening unit 1 during a coupling operation.

The roller positioner 2 preferably has a locking device 13 with a moveable pin 14, which in a limit position of the roller positioner 2 and the straightening unit 1 in the coupled state enters a hole 15 in the straightening unit 1 and, together with the guide pin 11, guarantees a defined fixed position of the roller positioner 2 in relation to the straightening unit 1.

To adjust the straightening roller 4, the adjusting mechanism 5 in the present embodiment has a setting screw 16 which is fixed to a coupling element 17. The coupling element 17 in this embodiment is of rotationally symmetric design, comprising a cylindrical part and an adjacent conical part and is arranged inside a locking sleeve 19, which in turn is arranged inside the housing 18 of the coupling part 9 such that it can rotate and be axially adjusted. The locking sleeve 19 has an internal shape adapted to the external shape of the coupling element 17 or vice versa. In this embodiment the locking sleeve 19 is pressurized by a compression spring 20 acting via an intermediate disk 21 and a sliding disk 22 such that the locking sleeve 19 is frictionally engaged in the coupling element 17. As the result of the frictional connection the setting screw 16 is prevented from turning and hence from adjusting the roller 4 coupled to it. This locking arrangement ensures that the last set roller position is fixed and cannot be adjusted intentionally or by accident, not even by using foreign tools. The coupling part 8 of the roller positioner 2 contains a rotationally symmetric coupling element 23 designed to transmit a rotary movement performed by means of the actuator 6.

Figure 2:
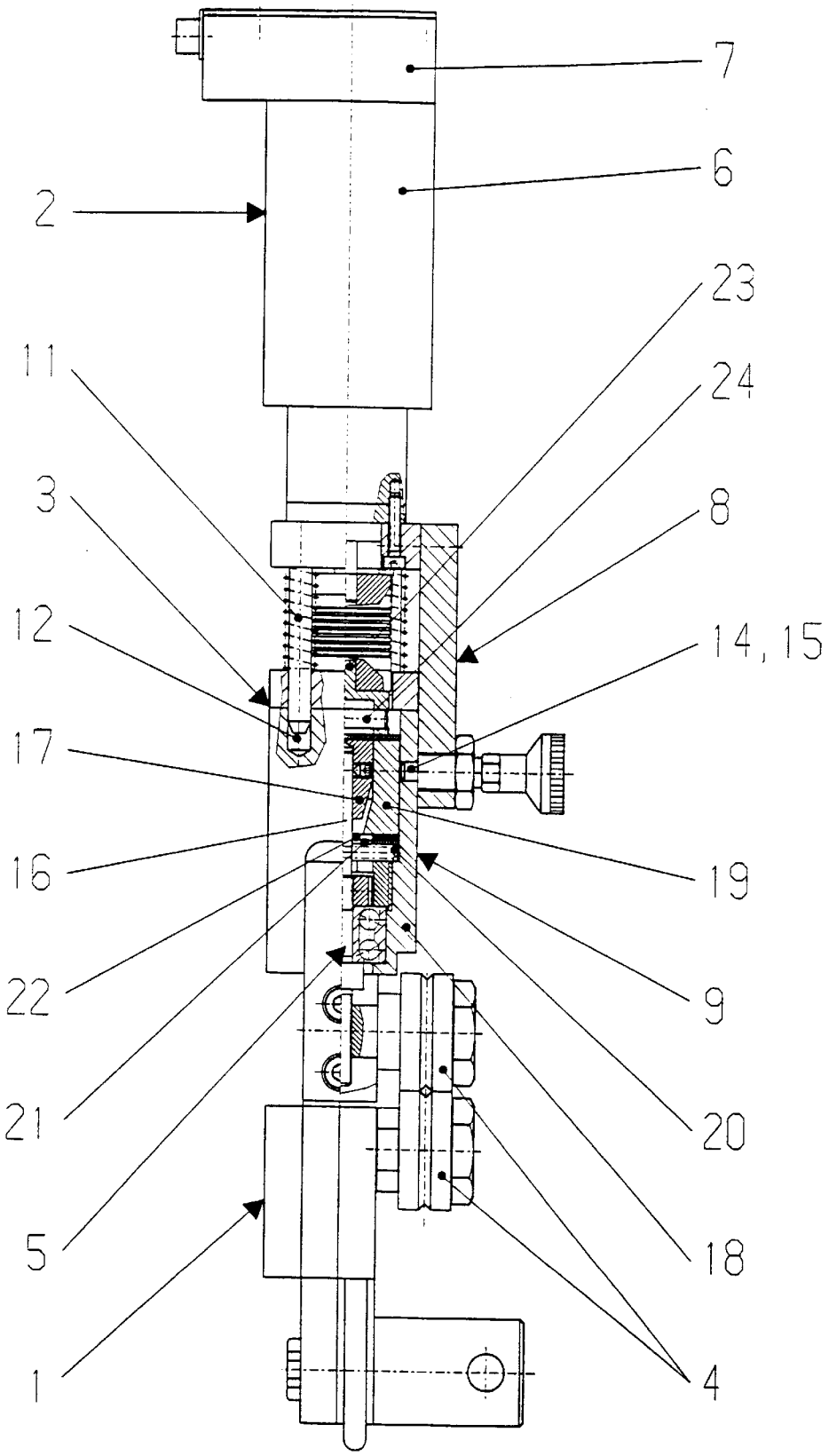
FIG. 2 is a partial sectional side view of the setting device shown in FIG. 1 but in a coupled state.

When, as shown in FIG. 2, the roller positioner 2 is coupled to the straightening unit 1 with the help of the guide pins 11 and the corresponding holes 12, the coupling element 23 of the roller positioner 2 comes into contact with the locking sleeve 19 and moves it against the force of the compression spring 20. Hence the locking sleeve 19 is no longer in frictional contact with the coupling element 17, and the coupling element 23 comes into contact with the coupling element 17. A connection is thus formed between the coupling elements 17 and 23, enabling the rotational force generated by the actuator 6 to be transmitted via the setting screw 16 to the rollers 4 in order to adjust them.

In accordance with a further embodiment the coupling element 23 of the roller positioner 2 is preferably equipped with a cylindrical pin 24 arranged diagonally to its active surface and designed to engage in a corresponding slot 25 in the front end of the coupling element 17 in order to form a keyed connection.

When using a "key-type connection" of this type it is necessary for the key elements to be aligned in relation to each other for reciprocal engagement, which in this case means arranging the cylindrical pin opposite the slot 25. First a sensor, not shown in the drawings identifies the respective setting screw 16, then the position sensor 7 determines the rotational angle position of the slot 25. Depending on the rotational angle position determined, the sensor sends a signal to the actuator 6, which before the roller positioner 2 is moved axially in the direction of the straightening unit 1 aligns the cylindrical pin 24 relative to the slot 25 such that the cylindrical pin 24 is able to enter the slot 25 during the relative movement of the roller positioner 2 in the direction of the straightening unit 1.

Any other types of coupling can be used instead of the frictional coupling and the key-type coupling described above. For example, as a coupling element of the straightening unit it is possible to use a nut for manual adjustment, whereby a three-armed gripper, for example, or some other type of key element can then be provided on the roller positioner as a coupling element.

When diverse adjusting mechanisms 5 are used on the straightening units it is possible, with one of the coupling elements 17, 23, to provide detachably connectable adapters to transmit the adjusting movement, thus guaranteeing that the adjusting device can be put to universal use with the most diverse adjusting mechanisms 5 as well.

Figure 3:
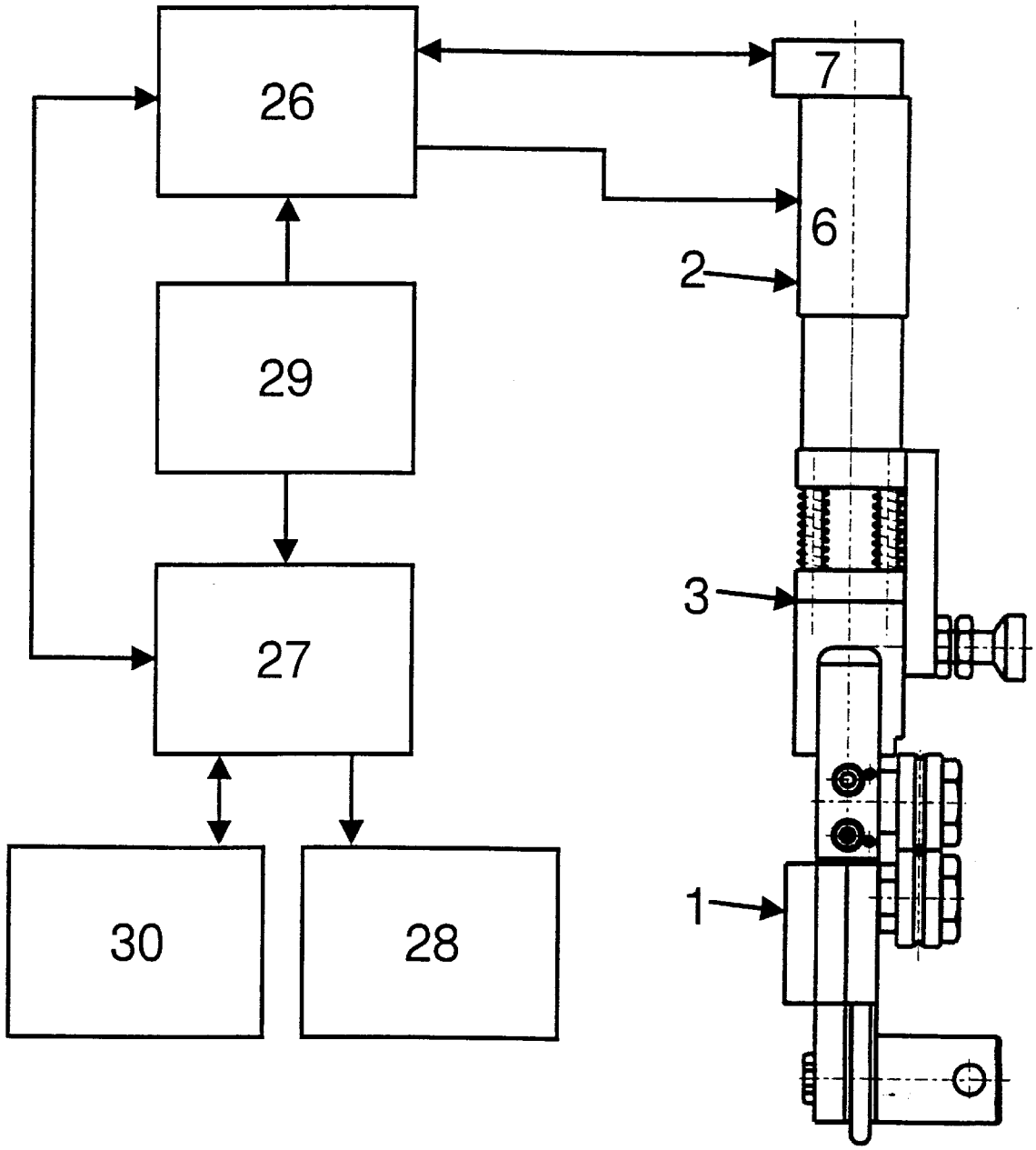
FIG. 3 is a side view of the setting device with the coupled straightening unit as well as a function diagram for performing a setting operation.

The roller positioner 2 is preferably connected to a positioning module 26 interlinked with the positioning sensor 7, the actuator 6 and a computing, storing, documenting and evaluating unit 27 (see FIG. 3), preferably with provision made for an additional documentation unit 28, whereby the units are connected to a power supply 29. If necessary, an interface 30 for connection to higher-level systems can also be assigned to the unit 27.

These units are used to process the information and data of the planned straightening processes. Each roller or its individual adjusting mechanism is identified by means of the sensor, not shown in the drawings. For this purpose it is possible for the coupling elements of each roller, for example, to be coded so that they transmit or reflect a specific signal when approached, for example, enabling them to be reliably identified and assigned by means of the sensor. A limit position is assigned to each roller to enable the actual position of the roller relative to the limit position to be determined automatically and the corresponding adjustment to be initiated automatically after each identification, whereby every set position can be documented to prevent having to first re-set the limit position with each re-coupling. Data such as speeds, acceleration rates, start and target positions, fringe or ambient conditions, and information about the process material such as its geometrical dimensions are entered for the initialization and positioning. Together with an index identifying each roller and/or each adjusting mechanism, all the data are stored, documented and if necessary calculated as well as visualized and/or made available via the interface to higher-level systems.

Hence the effort needed to set all the adjustable rollers is minimized, even through each adjustable roller has to be set individually one after the other in accordance with the pre-selected process material and the straightening process, thus guaranteeing the absolutely exact and reproducible setting of the roller and hence an improvement of straightening quality. The empirical, poorly reproducible and hence random setting of the adjustable straightening rollers is thus eliminated.

We claim:

1. In a setting device for setting straightening rollers (4) of a straightening unit (1) translationally adjustable by an adjusting mechanism, the improvement comprising: a roller positioner (2), a detachable coupling (3) for fixedly arranging the relative position between the roller positioner (2) and the adjusting mechanism (5) of an adjustable one of the straightening rollers (4), whereby a first coupling part (9) is connected to the adjusting mechanism (5) and a second coupling part (8) is connected to the roller positioner (2), a sensor device (7) to determine an actual position of the coupled straightening roller (4) in relation to a limit position, and an initializable actuator (6) for automatic setting of at least one of a specific pre-selectable position and a calculable position of the coupled straightening roller (4) in relation to the limit position.

2. A setting device in accordance with claim 1, wherein a sensor unit identifies one of any adjustable straightening roller (4) designed to be coupled and the adjusting mechanism (5).

3. A setting device in accordance with claim 1, wherein at least one sensor to identify a type and a position of the adjusting mechanism (5) is coupled.

4. In a setting device for setting straightening rollers (4) of a straightening unit (1) translationally adjustable by an adjusting mechanism, the improvement comprising:

a roller positioner (2), a detachable coupling (3) for fixedly arranging the relative position between the roller positioner (2) and the adjusting mechanism (5) of an adjustable one of the straightening rollers (4), whereby a first coupling part (9) is connected to the adjusting mechanism (5) and a second coupling part (8) is connected to the roller positioner (2), a sensor device (7) to determine an actual position of the coupled straightening roller (4) in relation to a limit position, and an initializable actuator (6) for automatic setting of at least one of a specific pre-selectable position and a calculable position of the coupled straightening roller (4) in relation to the limit position; and wherein a sensor unit identifies one of any adjustable straightening roller (4) designed to be coupled and the adjusting mechanism (5); and wherein a unit (27) stores a defined limit position of each adjustable straightening roller (4) to be coupled.

5. A setting device in accordance with claim 4, wherein setting of all the adjustable straightening rollers (4) of the straightening unit in relation to the limit position is stored in the storage unit (27) dependent on a required straightening process and on properties of a material to be straightened and is compared with an actual position of the coupled straightening roller (4), and a signal is sent, if necessary, to the actuator (6) to adjust the straightening roller (4) automatically in accordance with a set-point value for a respective straightening process for the respective material.

6. A setting device in accordance with claim 5, wherein at least one sensor to identify a type and a position of the adjusting mechanism (5) is coupled.

7. A setting device in accordance with claim 6, wherein a locking device for the adjusting mechanism unlocks during a coupling operation and locks during a decoupling operation.

8. A setting device in accordance with claim 7, wherein a detachable locking device (13) connects the coupling parts (8, 9) securely together.

9. In a setting device for setting straightening rollers (4) of a straightening unit (1) translationally adjustable by an adjusting mechanism, the improvement comprising:

a roller positioner (2), a detachable coupling (3) for fixedly arranging the relative position between the roller positioner (2) and the adjusting mechanism (5) of an adjustable one of the straightening rollers (4), whereby a first coupling part (9) is connected to the adjusting mechanism (5) and a second coupling part (8) is connected to the roller positioner (2), a sensor device (7) to determine an actual position of the coupled straightening roller (4) in relation to a limit position, and an initializable actuator (6) for automatic setting of at least one of a specific pre-selectable position and a calculable position of the coupled straightening roller (4) in relation to the limit position; and wherein a locking device unlocks during a coupling operation and locks during a decoupling operation.

10. In a setting device for setting straightening rollers (4) of a straightening unit (1) translationally adjustable by an adjusting mechanism, the improvement comprising:

a roller positioner (2), a detachable coupling (3) for fixedly arranging the relative position between the roller positioner (2) and the adjusting mechanism (5) of an adjustable one of the straightening rollers (4), whereby a first coupling part (9) is connected to the adjusting mechanism (5) and a second coupling part (8) is connected to the roller positioner (2), a sensor device (7) to determine an actual position of the coupled straightening roller (4) in relation to a limit position, and an initializable actuator (6) for automatic setting of at least one of a specific pre-selectable position and a calculable position of the coupled straightening roller (4) in relation to the limit position; and wherein a detachable locking device (13) connects the coupling parts (8, 9) securely together.

* * * * *